US007345426B2

(12) United States Patent
Wada et al.

(10) Patent No.: US 7,345,426 B2
(45) Date of Patent: Mar. 18, 2008

(54) ALLOY FOR A LEAD MEMBER OF AN ELECTRIC LAMP AND ELECTRODE STRUCTURE OF THE ELECTRIC LAMP

(75) Inventors: Yoshihiro Wada, Toyama (JP); Masahiro Katoh, Toyama (JP); Shinichi Irisawa, Shizuoka (JP); Takeshi Fukuyo, Shizuoka (JP)

(73) Assignee: A.L.M.T. Corporation, Tokyo (JP)

( * ) Notice: Subject to any disclaimer, the term of this patent is extended or adjusted under 35 U.S.C. 154(b) by 351 days.

(21) Appl. No.: 10/965,777

(22) Filed: Oct. 18, 2004

(65) Prior Publication Data

US 2005/0082984 A1 Apr. 21, 2005

(30) Foreign Application Priority Data

Oct. 16, 2003 (JP) ..... 2003-356296

(51) Int. Cl.
*H01J 17/04* (2006.01)
*H01J 61/04* (2006.01)

(52) U.S. Cl. ..... 313/631; 313/623; 313/633; 313/491

(58) Field of Classification Search ..... 313/623, 313/607, 631, 633, 491
See application file for complete search history.

(56) References Cited

U.S. PATENT DOCUMENTS 4,092,560 A * 5/1978 Puskas ..... 313/244
4,254,300 A 3/1981 Thompson-Russell
5,021,711 A 6/1991 Madden et al.
5,986,403 A * 11/1999 Jansen et al. ..... 313/623
2003/0052608 A1* 3/2003 Morimoto et al. ..... 313/633

FOREIGN PATENT DOCUMENTS

| | | | |
|---|---|---|---|
| DE | 29 47 230 | A1 | 11/1979 |
| DE | 30 06 849 | A1 | 2/1980 |
| EP | 0 309 749 | A1 | 8/1988 |
| EP | 0 691 673 | A | 1/1996 |
| EP | 1 156 505 | A1 | 11/2001 |
| EP | 1 294 012 | A2 | 3/2003 |
| JP | 8-55566 | A | 2/1996 |
| JP | 2001-6549 | A | 1/2001 |
| JP | 2001-23572 | A | 1/2001 |
| JP | 2002-33079 | A | 1/2002 |
| WO | WO 96/34405 | A2 | 10/1996 |
| WO | WO 03/056607 | A1 | 7/2003 |

* cited by examiner

*Primary Examiner*—Nimeshkumar D. Patel
*Assistant Examiner*—Kevin Quarterman
(74) *Attorney, Agent, or Firm*—Sughrue Mion, PLLC

(57) ABSTRACT

An alloy for a lead member is used for an electric lamp having a metal/vitreous material interface. Molybdenum or tungsten serving as an electric lamp current conductor is used as a base for the lead member, wherein the molybdenum or tungsten contains titanium oxide or other oxides. Automotive bulbs use this alloy for a lead member.

11 Claims, 5 Drawing Sheets

ALLOY FOR A LEAD MEMBER OF AN ELECTRIC LAMP AND ELECTRODE STRUCTURE OF THE ELECTRIC LAMP

This application claims priority to prior Japanese patent application JP 2003-356296, the disclosure of which is incorporated herein by reference.

BACKGROUND OF THE INVENTION

The present invention relates to alloys to be used as at least one lead member for an electric lamp that requires at least one metal/vitreous material junctions, and to electrode structures of the electric lamp. The vitreous material is quartz or a high temperature glass, for example alumino-silicate glass.

The material and the configuration of an electric conductor, a current conductor, or a lead member of an electric lamp having a vitreous or a glass envelope, has great effect on the structure, the function, and the quality of the electric lamp. The term "electric lamp" in this case includes various halogen incandescent lamps as well as electric discharge lamps, such as a high pressure mercury lamp, a metal halide lamp, or a high pressure xenon lamp. In addition, the term "lead member" may include a wide variety of leads, for example, a lead film, a lead foil, a plate, or the like.

This technological field has received much attention for a long time. A conductor for supplying an electric current to a gas-filled or a non-gas-filled electric lamp is generally sealed and joined by melting a quartz or a high temperature glass. Therefore, molybdenum and tungsten are used as a material for the current conductor because these melting point is high in all metals, these thermal expansion coefficient close to that of the vitreous materials.

Other characteristics required for molybdenum or tungsten as a conductor material include excellent ductility, excellent plasticity, high mechanical strength, oxidation resistance, corrosion resistance (particularly against halides), and excellent weldability with other conductor materials.

For example, German Patent DE 3006849 discloses that corrosion resistance is improved by coating an electric conductor comprising a molybdenum or tungsten foil with a secondary metal such as tantalum, niobium, vanadium, chromium, zirconium, titanium, yttrium, lanthanum, scandium or hafnium, using methods such as evaporation, cathode sputtering, electrolysis, and various other techniques.

Further, in order to produce an electric lamp using a material suitable as a current conductor foil, German Patent DE 2947230 proposes to use a novel molybdenum foil obtained by dispersing 0.25 to 1% yttrium oxide particles in an existing molybdenum foil.

Further, U.S. Pat. No. 5,021,711 proposes ion implantation of chromium, aluminum, or a combination of these metals in a surface layer of the molybdenum foil used as a current conductor within a vacuum bulb in order to improve the oxidation resistance of the molybdenum foil and to protect the molybdenum foil from oxidation.

Further, European Patent 0309749 proposes a technique in which molybdenum, which is used as a current conductor of an electric lamp, is coated in a seal area of the electric lamp with alkali metal silicate so as to improve oxidation resistance of molybdenum within an oxidizing atmosphere and at a high temperature of 250° C. to 600° C.

Further, Japanese Patent Application Publication (JP-A) No. 2002-33079 discloses a method of producing an electric light. In the disclosed method, a molybdenum foil is subjected to after-treatment so that heterogeneous surface structures and/or substantially non-contiguous insular regions of agglomerates of molybdenum or an alloy thereof are formed on 5 to 60% of the surface area of the molybdenum foil at a vapor pressure of in each case less than 10 mb (10 hPa) and at a temperature of 2000° C.

Further, Japanese Patent Application Publication (JP-A) No. 2001-06549 discloses a method of producing an automobile light bulb, incorporating a primary pinch-sealing method. An electrode assembly comprising an electrode rod, a molybdenum foil, and a molybdenum external lead connected in series is inserted through one end of a glass tube. An anti-oxidant gas is introduced through the other end, and temporary pinch-sealing is performed. Then, main pinch-sealing is performed under low pressure.

Further, Japanese Patent Application Publication (JP-A) No. 2001-23572 discloses a secondary pinch-sealing method. In the disclosed method, an electrode assembly is sealed and joined after introducing light-emitting substances and a discharge starting gas into a work which has been pinch-sealed by primary pinch-sealing.

However, industrial implementation of the coating in German Patent DE 3006849 is disadvantageous in that the manufacturing cost is high, a uniform thickness is difficult to obtain, and desired anti-corrosion effect is not obtained. Further, the coated electric conductor is inferior in weldability.

Further, the molybdenum foil disclosed in German Patent DE 2947230 is insufficient in corrosion resistance, particularly in oxidation resistance.

Further, the molybdenum foil disclosed in U.S. Pat. No. 5,021,711 is insufficient in weldability and requires much labor and cost, resulting in a marked increase in manufacturing cost of mass production of quartz bulb lamps.

Further, the current conductor wire provided with the coating layer as disclosed in Europe Patent EP 0309749 is disadvantageous in that the relatively costly method is required. Specifically, coating is carried out after welding. Therefore, the manufacturing cost is high and the brittleness is increased so that the parts are easily broken.

Further, in order to form the substantially non-contiguous insular regions of agglomerates as disclosed in Japanese Patent Application Publication (JP-A) No. 2002-33079, a new process must be added. This results in a problem of a markedly increase in manufacturing cost of mass production. In addition, it is necessary to highly sensitively control the manufacturing process, for example, to highly precisely control the surface condition for the surface area of 5 to 60% and to controllably suppress the average dimension of the agglomerates to 5 μm or less.

It is noted here that the alloy for a lead member of the present invention is used as a current conductor, an electric conductor, and a current conductor wire of an electric lamp, which may collectively be referred to as a "current conductor" hereinafter.

SUMMARY OF THE INVENTION

An object of the present invention is not only to provide a corrosion-resistant and oxidation-resistant alloy for an electrical lead member serving as a current conductor of an electric lamp and having a foil-like, a strip-like, or a cylindrical shape, but also improving adhesion between vitreous material and the lead member to prevent air from entering into the inside of a discharge lamp.

Another object of the present invention is to provide an inexpensive automobile light bulb as an electric lamp using the above-mentioned alloy as a inexpensive electrical lead of a electric lamp having a vitreous envelope.

In order to eliminate the disadvantage in the known material of the electrical lead of the electric lamp, i.e., insufficiency in corrosion resistance and oxidation resistance, the present inventors diligently and extensively studied. As a result, it has been found out that the above-mentioned disadvantage can be eliminated by adding titanium oxide and other oxide as additives to molybdenum or tungsten as a base so as to utilize eutectic reaction between the oxides and by adopting an airtightness improving configuration.

According to one aspect of the present invention, there is provided an alloy for a lead member used as a current conductor of an electric lamp. The alloy comprises molybdenum or tungsten as a base, wherein the alloy further comprises titanium oxide and other oxide as additives.

Preferably, the other oxide comprises at least one of zirconium oxide, lanthanum oxide, and cerium oxide.

Preferably, the total amount of the additives is within a range between 0.1 and 2.0 mass percents.

Preferably, the content of titanium oxide is between 0.01 and 1.82 mass percents and the ratio of zirconium oxide, lanthanum oxide, or cerium oxide as other oxide is within a range of 10 to 1000 mass percents with respect to titanium oxide.

According to another aspect of the present invention, there is provided a lead member of an electric lamp. The lead member is formed by the above-mentioned alloy. The lead member has a foil-like or a strip-like shape different from the shape of an external lead as a cylindrical shape.

According to still another aspect of the present invention, there is provided an electrode structure for use in an electric lamp has a lead member formed by the above-mentioned alloy. The lead has a foil-like or a strip-like shape different from the shape of an external lead as a cylindrical shape.

According to yet another aspect of the present invention, there is provided a lead member for use in an electric lamp having an external lead of a cylindrical shape. The lead and the external lead is formed integral by the above-mentioned alloy.

According to a further aspect of the present invention, there is provided an electrode structure for use in an electric lamp having a lead member and an external lead of a cylindrical shape. The lead member and an external lead is formed integral by the above-mentioned alloy.

According to a still further aspect of the present invention, there is provided an automobile light bulb using the above-mentioned alloy.

According to a yet further aspect of the present invention, there is provided an automobile light bulb using the above-mentioned lead member.

According to another aspect of the present invention, there is provided an automobile light bulb having the above-mentioned electrode structure.

According to the present invention, the alloy for a lead member can be manufactured at a low cost.

Each of zirconium oxide, lanthanum oxide, and cerium oxide markedly improves the dispersion into the vitreous material by the eutectic reaction with the titanium oxide. Therefore, the adhesion with the lead member is greatly improved. Further, development of cracks and occurrence of gaps as factors causing leakage are prevented and suppressed. As a result, it is possible to prevent air from entering into a discharge lamp. Thus, according to the present invention, a corrosion-resistant and oxidation-resistant alloy for a lead member can be provided as a current conductor of an electric lamp having a vitreous envelope.

The electric lamp using the alloy for a lead member according to the present invention is applicable to an automobile light bulb as an electric lamp for an automobile and so on.

DESCRIPTION OF THE PREFERRED EMBODIMENTS

Next, the present invention will be described in detail with reference to the drawings.

Figure 1:
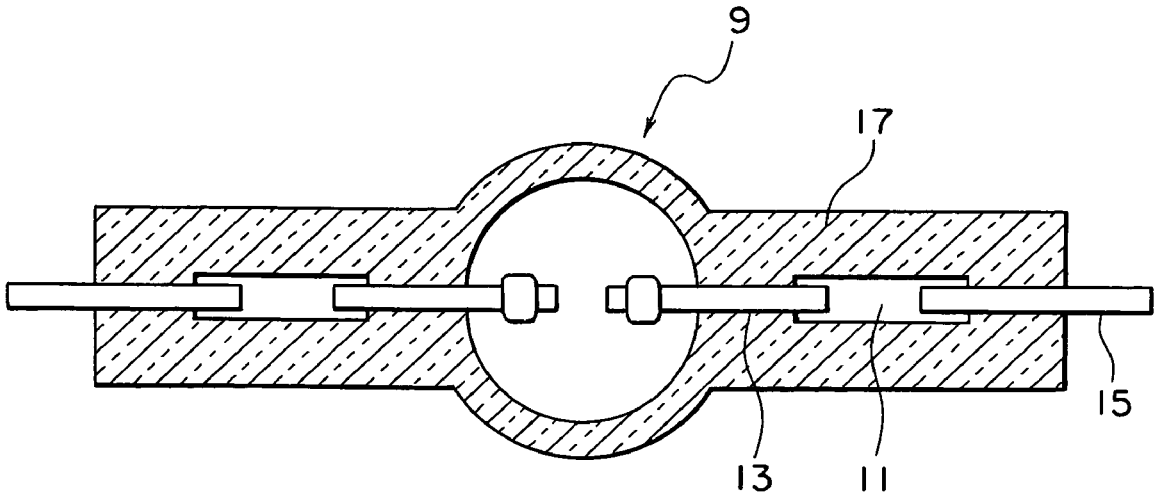
FIG. 1 is a horizontal sectional view illustrating a characteristic part of an electric lamp according to a first embodiment of the present invention.
Figure 2:
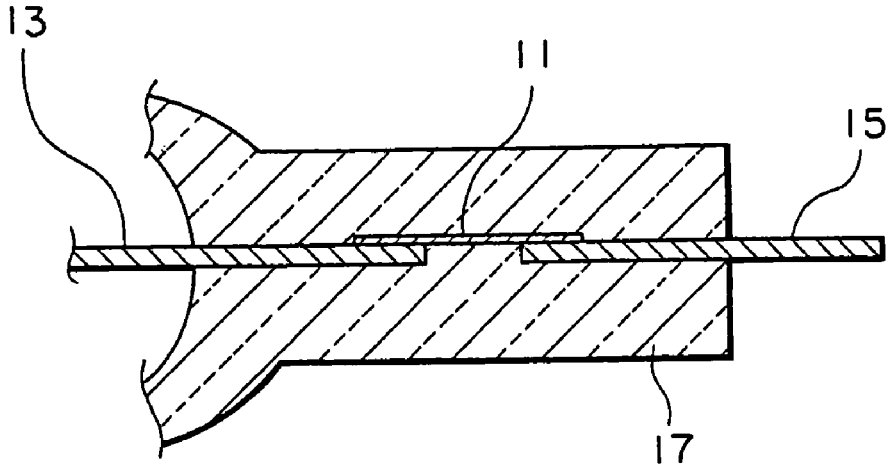
FIG. 2 is a vertical sectional view of the characteristic part of the electric lamp in FIG. 1.

Referring to FIGS. 1 and 2, an electric lamp 9 according to a first embodiment of the present invention comprises a pair of molybdenum (Mo) lead members 11, a pair of tungsten (W) electrodes 13 serving as internal electrodes, a pair of external leads 15, and a quartz glass tube 17. One end of each tungsten electrode 13 and one end of each external lead 15 are bonded to opposite ends of the lead member 11. The lead member 11, the tungsten electrode 13, and a part of the external lead 15 are sealed in the quartz glass tube 17 so that the other end of the tungsten electrode 13 is received in a hollow portion of the quartz glass tube 17. In the illustrated example, the lead member 11 has a flat shape.

Figure 3:
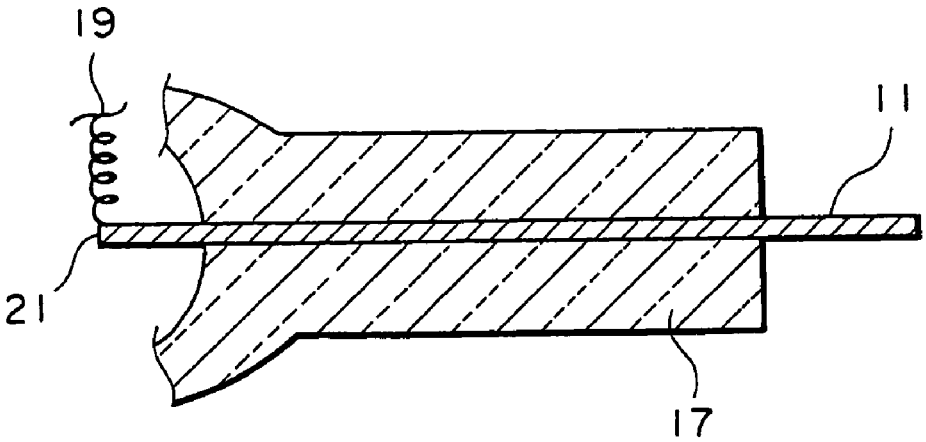
FIG. 3 is a vertical sectional view illustrating a characteristic part of an electric lamp according to a second embodiment of the present invention.

Referring to FIG. 3, an electric lamp according a second embodiment of the present invention is similar to the first embodiment except that the lead member 11 also serves as the external lead 15 in FIGS. 1 and 2. In case where the lead member 11 also serves as the external lead 15 (see FIG. 1), the lead member 11 has a cylindrical shape and is bonded to a tungsten filament 19 by butt welding, i.e., end-to-end welding, resistance welding, or the like to form a joined portion 21.

Now, description will be made of an alloy as a material of the lead member 11 in detail.

According to the present invention, the lead member as a current conductor of an electric lamp is made of an alloy comprising molybdenum or tungsten as a base. In addition to molybdenum or tungsten as a base, the alloy comprises, as additives, a combination of titanium oxide and other oxide, for example, a combination of titanium oxide and zirconium oxide, a combination of titanium oxide and lanthanum oxide, or a combination of titanium oxide and cerium oxide. Preferably, the total amount of the additives is within a range between 0.1 and 2.0 mass percents, with the balance being molybdenum or tungsten. More preferably, the content of titanium oxide is between 0.01 and 1.82 mass percents, and the ratio of zirconium oxide, lanthanum oxide, or cerium oxide as other oxide is within a range of 10 to 1000 mass percents with respect to titanium oxide.

Further, the lead member comprising the above-mentioned alloy according to the present invention has a foil-like or a band-like shape which is different from the shape of the external lead as a cylindrical shape, or a cylindrical shape.

Further, an electrode structure of an electric lamp is obtained by the use of the above-mentioned alloy.

The alloy for the lead member as a current conductor of an electric lamp according to the present invention is usable in various halogen incandescent lamps as well as electric discharge lamps, such as a high pressure mercury lamp, a high pressure xenon lamp, or a metal halide lamp.

The alloy for a lead member of an electric lamp according to the present invention may have various configurations and dimensions and can be used, for example, as a thin elliptical etching foil, a strip-like shape, or a cylindrical shape within the electric lamp.

Further, the current conductor or the lead member according to the present invention does not impose any restriction upon continuously using a typical manufacturing process of an electric lamp, particularly, a metal/vitreous material sealing and bonding apparatus.

For example, the current conductor comprising the above-mentioned alloy according to the present invention can be welded at its end to another current supplying lead and can be sealed airtight within a quartz glass together with a welded and joined portion.

As compared with a molybdenum material doped with yttrium oxide as a dispersoid, the current conductor comprising the above-mentioned alloy according to the present invention is remarkably improved in corrosion resistance and oxidation resistance, even at a considerably high concentration of oxygen. Therefore, an electric lamp comprising the current conductor according to the present invention is improved in long-term storage durability and extended in lighting life. Supposedly, this is concerned with the effect of lowering a melting point due to the eutectic reaction of the alloy of the present invention as well as excellent dispersion into the vitreous material.

Further, other quality characteristics of the conductor according to the present invention are not inferior to a best-quality conductor material known in this technological field.

Specifically, the alloy for a lead member of an electric lamp according to the present invention has the following advantages:

(a) peeling of the foil upon hermetic sealing is suppressed because of a favorable surface structure of an etched conductive foil;

(b) occurrence of cracks due to recrystallization upon enclosing the conductor is suppressed because the material has a fine-particle stable structure; and (c) the recrystallization temperature is as relatively low as 1300° C. or below so that stress concentration (formation) between the conductor material and the vitreous material is reduced, thereby avoiding occurrence of breaks and cracks in the vitreous envelope.

Generally, a molybdenum foil or a molybdenum strip is subjected to etching by the use of an etching reagent. In particular, such etching is widely used to reduce the thickness of the conductor at a lateral edge portion of the conductive foil.

As compared with the case where yttrium oxide is used as a dispersoid, the eutectic reaction of titanium oxide in the alloy for a lead member of the present invention has a lower melting point. It is therefore unnecessary to dope the additives in a solution. By dry-blending molybdenum or tungsten with the additives, it is possible to achieve sufficiently fine and uniform dispersion. Therefore, the alloy for a lead member can be manufactured at a low cost. Further, the adhesion with the vitreous material is markedly improved as compared with the case of molybdenum and yttrium oxide.

Further, in the alloy for a lead member of the present invention, the melting point of each of zirconium oxide, lanthanum oxide, and cerium oxide is lowered by the eutectic reaction with titanium oxide. Therefore, the dispersion into the vitreous material is advantageously improved.

As the configuration of the lead member, a foil is widely used because the joined area between the lead member and the vitreous material is increased, which is advantageous in preventing and suppressing occurrence of cracks and gaps as factors causing leakage. However, in the present invention, other shapes such as a wire and a rod corresponding to a cylinder may be used.

Next, specific examples of the alloy for a lead member according to the present invention and the method of manufacturing the same will be described. Molybdenum or tungsten products manufactured by the use of powder metallurgy were made from typical molybdenum powder or tungsten powder having an average grain size of 4 μm. We used these typical powders.

First, titanium oxide and one of zirconium oxide, lanthanum oxide, and cerium oxide as additives were mixed with molybdenum or tungsten powder. The amount of titanium oxide was 0.01 to 1.82 mass percents. The ratio of zirconium oxide, lanthanum oxide, or cerium oxide was 10 to 1000 mass percents with respect to titanium oxide. The total amount of the additives does not exceed 2 mass percents. Mixing was carried out for one hour in a shaker mixer to produce raw material powder having uniform dispersion. The powder was press-formed by a press to obtain a green compact. This green compact was sintered for five hours in hydrogen at 1850° C. to obtain an ingot. The ingot was processed into a wire material by the use of a rolling apparatus, a hammering apparatus, and a wire drawing apparatus which have been generally used. A lead foil was produced from the wire material thus obtained.

Next referring to FIGS. 4A through 4D and 5, the manufacturing process of the electric lamp illustrated in FIG. 1 will be described.

Figure 4E:
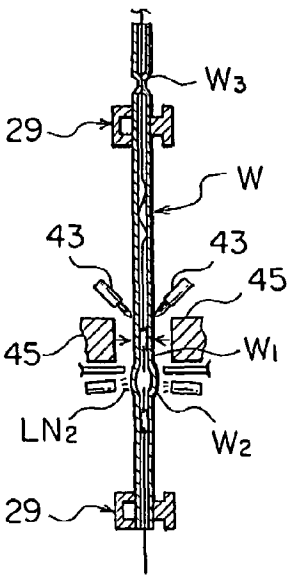
FIGS. 4A to 4E are schematic sectional views illustrating a manufacturing process of the electric lamp in FIG. 1.
Figure 4D:
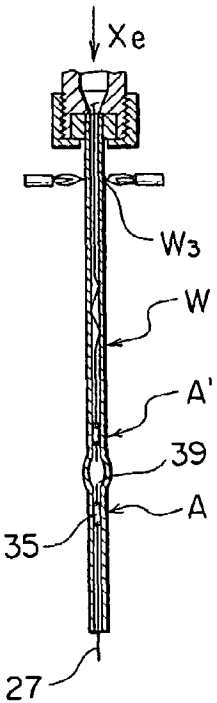
Figure 4C:
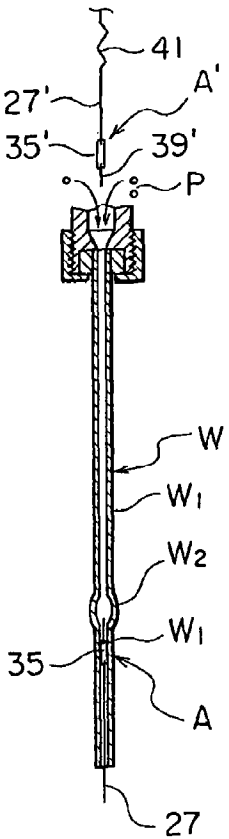
Figure 4A:
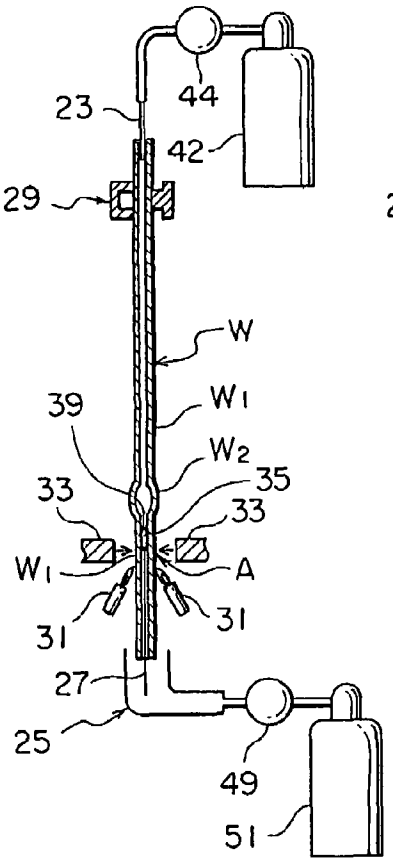
Figure 5:
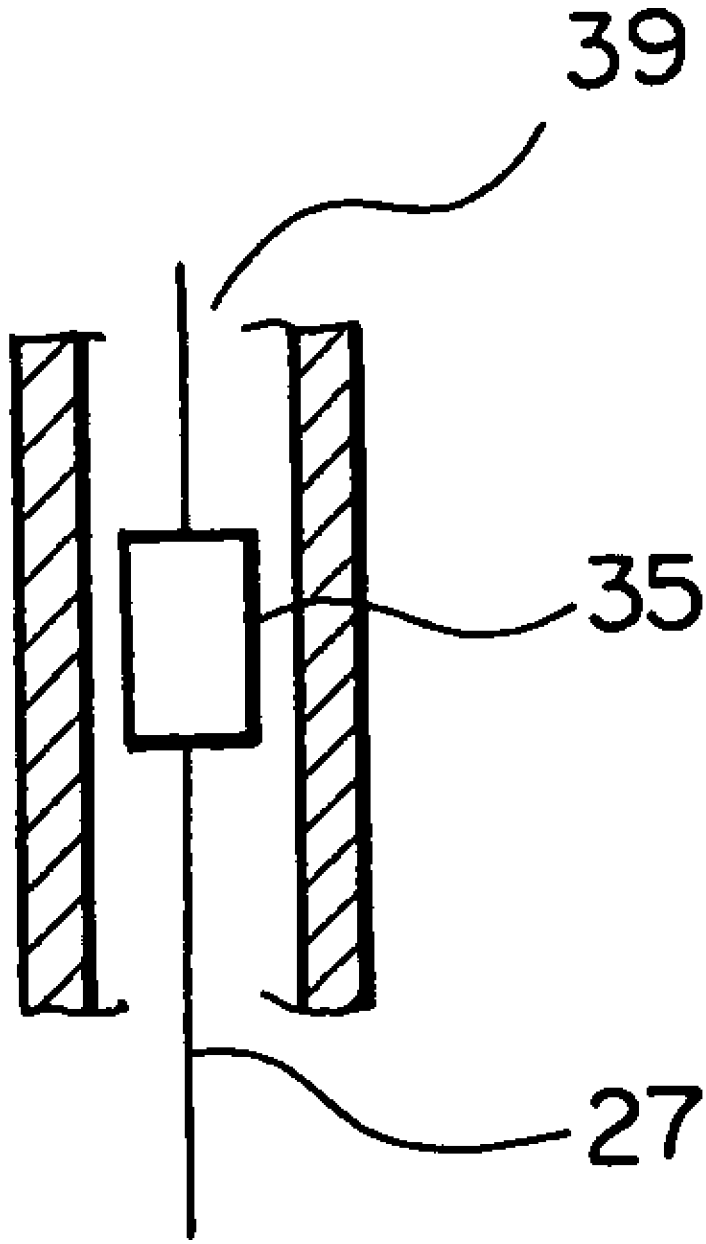
FIG. 5 is an enlarged view of an electrode assembly A shown in FIG. 4A.

First, a glass tube or vitreous envelope W having straight extending portions $w_1$ and a spherical expanding portion $w_2$ formed at an intermediate position of the straight tube is produced. Then, as illustrated in FIGS. 4A and 5, the glass tube W is held vertically. An electrode assembly A is inserted through a lower opening end of the glass tube W and held at a predetermined position in the glass tube W. A supply nozzle 23 for supplying a forming gas, such as an argon gas, is inserted into an upper opening end of the glass tube W. Further, a lower end portion of the glass tube W is inserted into a gas supply pipe 25.

The forming gas supplied from the nozzle 23 serves to keep the inside of the glass tube W in a pressurized state at the time of pinch-sealing and to prevent the electrode assembly A from being oxidized. An inert gas, such as an argon gas or a nitrogen gas, supplied from the gas supply pipe 25 serves to maintain an inert gas atmosphere during and after the pinch-sealing while an external lead 27 is at a high-temperature, and to thereby prevent oxidation. The glass tube W is perpendicularly kept by a glass tube clamping jig 29.

Then, as illustrated in FIGS. 4A and 5, the forming gas is supplied from the nozzle 23 connected to a reservoir 42 through a gas valve 44 into the glass tube W. Further, the inert gas is supplied from the pipe 25 connected to a reservoir 51 through gas valve 49 to the lower end portion of the glass tube W. At the same time, a part of the straight extending portion $w_1$ which is adjacent to the spherical expanding portion $w_2$ (i.e., a part containing a molybdenum foil 35) is heated with burners 31 up to 2100° C. A part of the molybdenum foil 35 which is connected to the external lead 27 is temporarily pinch-sealed using a pincher 33.

Figure 4B:
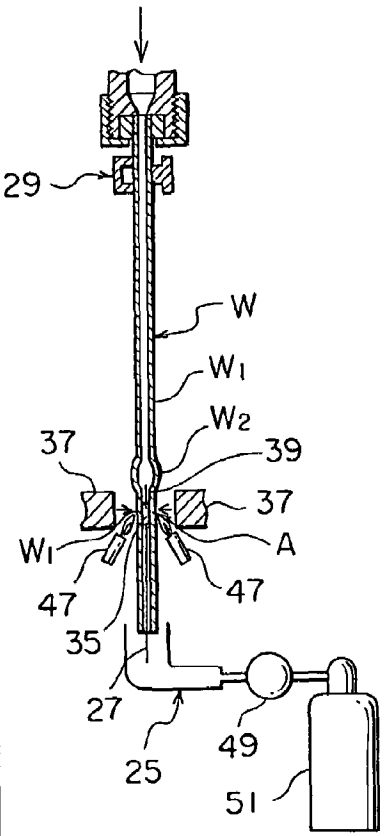

Next referring to FIG. 4B, after the temporary pinch-sealing, the inside of the glass tube W is kept at a vacuum using a vacuum pump (not shown), and an unsealed portion, containing the molybdenum foil 35, which is not yet pinch-sealed is subjected to main pinch-sealing by the pincher 37. Herein, the burners are represented by a reference number 47. The degree of vacuum in the inside of the glass tube W is preferably 400 Torr to $4\times10^{-3}$ Torr.

At a primary pinch-seal portion thus obtained, a glass layer is tightly adhered to and hermetically contacted with the external lead 27, the molybdenum foil 35, and an electrode rod 39 which form the electrode assembly A. In particular, at a part sealed by the main pinch-sealing, the glass layer is tightly adhered to and hermetically contacted in sufficient conformity with the electrode rod 39 and the molybdenum foil 35 without leaving any gap and, therefore, the glass layer and the molybdenum foil 35 (electrode rod 39) are firmly joined to each other. In the main pinch-sealing, by maintaining the lower opening portion of the glass tube W in an inert gas atmosphere (such as an argon gas or a nitrogen gas), the external lead 27 is prevented from being oxidized.

Next, as illustrated in FIG. 4C, light-emitting substances P are supplied from the upper opening end of the glass tube W into the spherical expanding portion $w_2$. From the upper opening end of the glass tube W, another electrode assembly A' comprising an electrode rod 39', a molybdenum foil 35', and an external lead 27' integrally connected is inserted and held at a preselected position. The external lead 27' has a W-shaped bent portion 41 formed at an intermediate position in its longitudinal direction. The bent portion 41 is press-contacted against an inner peripheral surface of the glass tube W so as to position and hold the electrode assembly A' at the preselected position in the longitudinal direction of the straight extending portion $w_1$.

Next referring to FIG. 4D, after evacuating the inside of the glass tube W, a xenon gas is supplied to the inside of the glass tube W. At the same time, a predetermined upper position of the glass tube W is chipped off to temporarily fix the electrode assembly A' in the glass tube W and to seal the light-emitting substances. A reference symbol $w_3$ denotes a chipped-off portion.

Thereafter, as illustrated in FIG. 4E, a part of the straight extending portion $w_1$ which is adjacent to the spherical expanding portion $w_2$ (i.e., a part containing the molybdenum foil) is heated with burners 43 up to 2100° C. while cooling the spherical expanding portion $w_2$ with liquid nitrogen ($LN_2$) so as to prevent the light-emitting substances P from being vaporized. By the use of a pincher 45, secondary pinch-sealing is carried out to seal the spherical expanding portion $w_2$. Thus, a glass tube having a chipless closed chamber is obtained in which the electrodes 39 and 39' are faced to each other and the light-emitting substances P are enclosed.

In the secondary pinch-sealing process, it is unnecessary to evacuate the inside of the glass tube W to a negative pressure by the use of a vacuum pump as in the main pinch-sealing of the primary pinch-sealing process. In this case, by liquefying the xenon gas enclosed within the glass tube W, the inside of the glass tube W is kept at a negative pressure. Therefore, the adhesion of the glass layer to the electrode assembly A' (electrode rod 39', molybdenum foil 35', external lead 27') at the secondary pinch-sealing portion is excellent.

Specifically, like in the main pinch-sealing in the primary pinch-sealing process, the negative pressure acts upon the glass layer heated and softened in addition to pressing force exerted by the pincher 45. Therefore, the glass layer is hermetically contacted in sufficient conformity with the electrode rod 39', the molybdenum foil 35', and the external lead 27' without leaving any gap. Consequently, the glass layer and the electrode rod 39', the molybdenum foil 35', and the external lead 27' are firmly joined together.

Finally, by cutting the end portion of the glass tube by a predetermined length, the electric lamp 9 illustrated in FIG. 1 is obtained.

Figure 6:
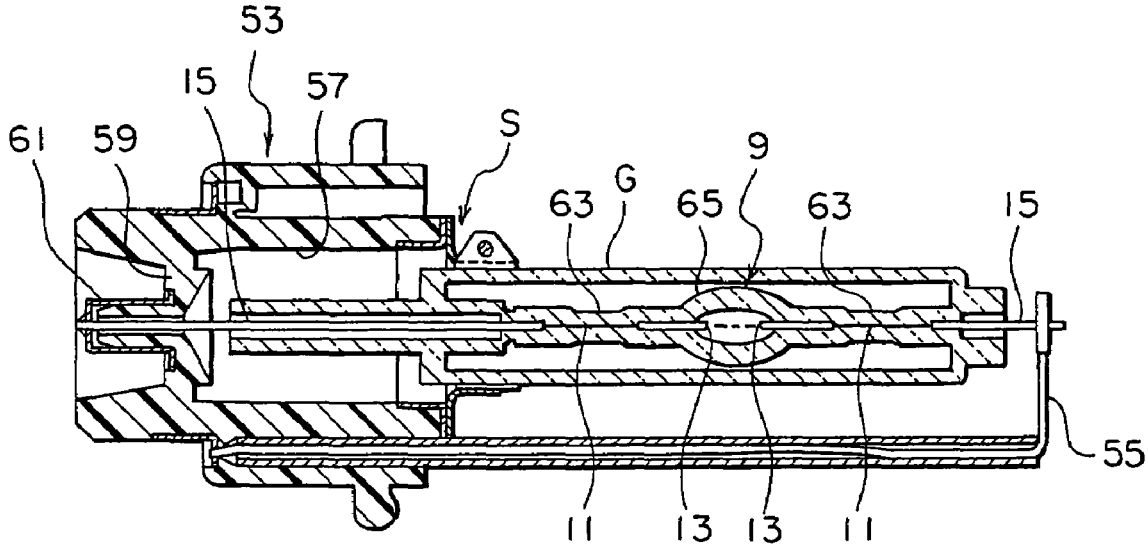
FIG. 6 is a sectional view of a discharge lamp unit comprising the electric lamp in FIG. 1.

Referring to FIG. 6, the electric lamp 9 for an automobile, i.e., an automobile light bulb, is incorporated into a discharge lamp unit. The electric lamp 9 having a front end portion supported by one lead support 55 projecting forward from an insulated base 53 and a rear end portion supported by a recessed portion 57 of the base 53. Further, a portion of the electric lamp 9 which is adjacent to the rear end portion is clamped by a metal support S secured to a front surface of the insulated base 53.

A front external lead 15 extending from the electric lamp 9 is secured to the lead support 55 by welding while a rear external lead 15 penetrates a bottom wall 59 of the recessed portion 57 of the base 53 and is secured by welding to a terminal 61 formed on the bottom wall 59. An ultraviolet ray shielding globe G having a cylindrical shape and serving to cut off an ultraviolet ray which has a harmful wavelength region to the human body of a light emitted from the electric lamp 9. The globe G is integrally welded to the electric lamp 9.

The electric lamp 9 has a structure in which a sealed chamber portion 65 is formed between a pair of front and rear pinch-seal portions 63. The sealed chamber portion 65 has a pair of electrodes 13 and 13 disposed opposite to each other and contains light emitting substances. In the pinch-seal portion 63, the molybdenum foil 11 is sealed and connects the electrode rod 13 projecting into the sealed chamber portion 65 and the external lead 15 extending from the pinch-seal portion 63 to each other. Thus, the airtightness of the pinch-seal portion 63 is assured.

Herein, pinch-sealing is carried out at 2100° C. by way of example. However, the pinch-sealing temperature may be selected within a range between 1650° C. and 2500° C. At the temperature not lower than 1650° C. which is a softening temperature of the glass, diffusion of the alloy is started. At the temperature not higher than 2500° C., industrial productivity associated with the maintenance of the apparatus is not degraded.

By way of example, the lead foil, such as molybdenum foil, has a thickness of 20 μm and a width of 1.5 mm. However, if the current capacity is required, the size of the lead foil may be increased or a plurality of foils may be used.

Table 1 shows the result of the life test of a typical 35 W automobile light bulb manufactured in the above-mentioned manner. It is noted here that the life test is an evaluation method which is most reliable and which can directly evaluate adhesion characteristics in use of the product. Other peeling tests are difficult to execute particularly because poor workability of the glass. Therefore, the adhesion characteristics were judged by the life test shown in Table 1. The life test was performed in accordance with IEC60810 in an on/off cycle shown in Table 2.

TABLE 1

Life Test Result of Automobile Light Bulb 1500-Hour Lighting Test

| | Base | Ratio of Additives to Base Metal | Number of Failures |
|---|---|---|---|
| Present Invention | Mo | 0.02 mass % $TiO_2$-0.15 mass % $ZrO_2$ | 0/20 |
| | | 0.20 mass % $TiO_2$-1.7 mass % $ZrO_2$ | 0/20 |
| | | 1.60 mass % $TiO_2$-0.30 mass % $ZrO_2$ | 0/20 |
| | | 0.13 mass % $TiO_2$-0.03 mass % $ZrO_2$ | 0/20 |
| | | 0.17 mass % $TiO_2$-1.5 mass % $La_2O_3$ | 0/20 |
| | | 1.7 mass % $TiO_2$-0.2 mass % $La_2O_3$ | 0/20 |
| | | 0.03 mass % $TiO_2$-0.16 mass % $La_2O_3$ | 0/20 |
| | | 0.21 mass % $TiO_2$-1.6 mass % $Ce_2O_3$ | 0/20 |
| | | 1.7 mass % $TiO_2$-0.3 mass % $Ce_2O_3$ | 0/20 |
| | W | 0.21 mass % $TiO_2$-1.6 mass % $ZrO_2$ | 0/20 |
| | | 1.61 mass % $TiO_2$-0.32 mass % $ZrO_2$ | 0/20 |
| | | 0.17 mass % $TiO_2$-1.6 mass % $La_2O_3$ | 0/20 |
| | | 1.6 mass % $TiO_2$-0.31 mass % $La_2O_3$ | 0/20 |
| | | 0.19 mass % $TiO_2$-1.5 mass % $Ce_2O_3$ | 0/20 |
| | | 1.8 mass % $TiO_2$-0.32 mass % $Ce_2O_3$ | 0/20 |
| Beyond the Range of Present Invention | Mo | 0.005 mass % $TiO_2$-0.010 mass % $ZrO_2$ | 9/20 |
| | | 2.2 mass % $TiO_2$-3.5 mass % $Ce_2O_3$ | — |
| | W | 0.006 mass % $TiO_2$-0.008 mass % $ZrO_2$ | 8/20 |
| | | 2.1 mass % $TiO_2$-3.7 mass % $Ce_2O_3$ | — |
| Comparative Example | Mo | Pure molybdenum | 15/20 |
| | | 0.4 mass % $Y_2O_3$-0.15 mass % $Ce_2O_3$ | 1/20 |

*The failure standard in 1500 hour lighting test is unlighting due to leakage resulting from crack development
*The life test was carried out in accordance with IEC60810. (see Table 2)
*Element analysis was carried out in accordance with JIS H 1403 and 1404 by ICP (Inductively Coupled Plasma) emission spectroscopy.

TABLE 2

| Number of Times | ON (minutes) | OFF (minutes) |
|---|---|---|
| 1 | 20 | 0.2 |
| 2 | 8 | 5 |
| 3 | 5 | 3 |
| 4 | 3 | 3 |
| 5 | 2 | 3 |
| 6 | 1 | 3 |
| 7 | 0.6 | 3 |
| 8 | 0.3 | 0.3 |
| 9 | 20 | 4.7 |
| 10 | 20 | 15 |

In case where alloys containing more than 2 mass percents of a combination of titanium oxide and zirconium oxide, a combination of titanium oxide and lanthanum oxide, or a combination of titanium oxide and cerium oxide were produced, the material became fragile and the production yield dramatically decreased. Accordingly, industrial products could not be obtained. Further, in case where alloys containing more than 5 mass percents of a combination of titanium oxide and zirconium oxide, a combination of titanium oxide and lanthanum oxide, or a combination of titanium oxide and cerium oxide, electrical resistance increased and, therefore, the function as a current conductor could not be achieved.

Further, an alloy containing less than 0.1 mass percent of a combination of titanium oxide and zirconium oxide, a combination of titanium oxide and lanthanum oxide, or a combination of titanium oxide and cerium oxide was produced.

In case where the content of titanium oxide was 0.01 to 2.0 mass percents and the ratio of zirconium oxide, lanthanum oxide, or cerium oxide was 10 mass percents or 1000 percents or more, lowering of the melting point owing to production of eutectic crystals of oxides could not be observed. Thus, the adhesion characteristics as the alloy for a lead member could not be obtained.

In Table 1, the failure standard of the typical 35 W automobile light bulb 1500-hour lighting test is unlighting due to leakage resulting from crack development from the interface between the quartz glass and the alloy for a lead member.

Further, electric lamps were produced in the manner similar to that mentioned in Japanese Patent Application Publication (JP-A) No. 2001-06549 and Japanese Patent Application Publication (JP-A) No. 2001-23572.

The term "strip" represents a material having a rectangular section without being limited to an extremely thin current conductor represented by a foil (tape, film). The strip exhibits the performance equivalent to that of the foil and is identical in intended use and manner of use to the foil.

On the other hand, a round rod is directly joined with an internal tungsten filament, as illustrated in FIG. 3. In this case also, the similar effect of extending the life is obtained. Table 3 shows the results of the life test of a typical 55 W halogen lamp using a cylindrical lead member having a diameter of 0.4 mm.

TABLE 3

Data Relating to Life of Halogen Lamps

| Composition | Life (Number of times of on/off switching operation) |
|---|---|
| Mo 0.2 mass % $TiO_2$-1.7 mass % $ZrO_2$ | survived after 100,000 times |
| Mo 0.17 mass % $TiO_2$-1.5 mass % $La_2O_3$ | survived after 100,000 times |
| Mo 0.21 mass % $TiO_2$-1.6 mass % $ZrO_2$ | survived after 100,000 times |
| Mo | 30,000 times |

In this case, because the internal pressure of the electric lamp is lower than that of a discharge lamp, it is unnecessary to resist a very high pressure. The cylindrical lead member also serves as the external lead and is directly joined to the internal tungsten filament. Alternatively, the lead member having a same diameter may be used as the external lead and sealed in the vitreous material. In order to improve the adhesion characteristics, the lead member may be different in diameter from the tungsten filament, may have an elliptical shape, may be eccentrically joined to the tungsten filament, may be joined to the tungsten filament not in parallel but with a certain angle.

While this invention has thus far been described in conjunction with the preferred embodiments thereof, it will be readily possible for those skilled in the art to put this invention into practice in various other manners without departing from the scope of this invention.

What is claimed is:

1. An alloy for a lead member used as a current conductor of an electric lamp, said alloy comprising molybdenum or tungsten as a base, wherein said base further comprises titanium oxide and at least one oxide selected from a group consisting of zirconium oxide, lanthanum oxide, and cerium oxide as additives;

wherein the content of titanium oxide being between 0.01 and 1.82 mass percents, the ratio of the at least one oxide to titanium oxide falling within a range between 1/10 to 10 by weight ratio.

2. An alloy according to claim 1, wherein the total amount of the additives falls within a range between 0.1 and 2.0 mass percents.

3. A lead member of an electric lamp, said lead member being formed by the alloy according to claim 1, said lead having a foil or a strip shape different from the shape of an external lead as a cylindrical shape.

4. An electrode structure for use in an electric lamp having a lead member formed by the alloy according to claim 1, wherein said lead member has a foil or a strip shape different from the shape of an external lead as a cylindrical shape.

5. A lead member for use in an electric lamp having an external lead of a cylindrical shape, wherein said lead member and said external lead are formed integral by the alloy claimed in claim 1.

6. An electrode structure for use in an electric lamp having a lead member and an external lead of a cylindrical shape, wherein said lead member and said external lead are formed integral by the alloy claimed in claim 1.

7. An automobile light bulb using the alloy according to claim 1.

8. An automobile light bulb using the lead member according to claim 3.

9. An automobile light bulb using the lead member according to claim 5.

10. An automobile light bulb having the electrode structure according to claim 4.

11. An automobile light bulb having the electrode structure according to claim 6.

* * * * *